United States Patent [19]

McCubbin et al.

[11] 4,351,240

[45] Sep. 28, 1982

[54] INCENDIARY FRAGMENTARY WARHEAD

[75] Inventors: Melvin J. McCubbin; Clifford T. Johnson; Paul E. Cordle, all of China Lake, Calif.

[73] Assignee: The United States of America as represented by the Secretary of the Navy, Washington, D.C.

[21] Appl. No.: 553,852

[22] Filed: Feb. 28, 1975

[51] Int. Cl.[3] ..... F42B 11/24

[52] U.S. Cl. ..... 102/364; 102/493; 102/496

[58] Field of Search ..... 102/66, 67, 364, 493, 102/496

[56] References Cited

U.S. PATENT DOCUMENTS

| | | | |
|---|---|---|---|
| 3,474,731 | 10/1969 | Thomanek | 102/67 |
| 3,498,224 | 3/1970 | Cordle et al. | 102/67 |
| 3,518,942 | 7/1970 | Philipchuk | 102/66 |
| 3,830,671 | 8/1974 | McArdle | 102/66 |

FOREIGN PATENT DOCUMENTS

| | | | |
|---|---|---|---|
| 669449 | 8/1963 | Canada | 102/67 |
| 1177716 | 12/1958 | France | 102/67 |

*Primary Examiner*—Peter A. Nelson

*Attorney, Agent, or Firm*—R. F. Beers; W. Thom Skeer

[57] ABSTRACT

A warhead comprising an explosive charge surrounded by discrete individual metal fragments is increased in effectiveness by the addition of pyrophoric fragment material combined therewith. For this purpose, misch metal or zirconium-tin sleeves are placed around or within the fragmentation layers or, alternatively, a percentage of the ferrous metal cubes are replaced with a number of preformed zirconium fragments.

2 Claims, 3 Drawing Figures

INCENDIARY FRAGMENTARY WARHEAD

CROSS REFERENCE TO RELATED APPLICATION

A fragmentation warhead of the type which may be improved by the present invention is disclosed in Assignee's prior application Ser. No. 766,040 filed Oct. 4, 1968, and now U.S. Pat. No. 3,498,224.

BACKGROUND OF THE INVENTION

This invention relates to warheads and particularly to warheads incorporated in missiles and more particularly to a guided missile warhead which incorporates preformed metal cubes for fragmentation. Most particularly this application relates to the improvement of such warheads by the addition of pyrophoric material thus giving the warhead additional effectiveness when used against targets which include flammable material.

SUMMARY

According to the present invention pyrophoric material is added to or substituted for a portion of the fragmentary material in the warhead. In one embodiment, for example, zirconium cubes are substituted for a portion of the steel cubes and mixed therewith before pouring the cubes into the warhead cavity. A second modification is fitted with a sleeve of misch metal comprising extruded misch metal rods substituted in place of some peripheral fragment cubes. A third embodiment is disclosed which comprises sleeves of zirconium-tin added in addition to the full complement of steel fragmentation cubes.

DESCRIPTION AND OPERATION

Figure 1:
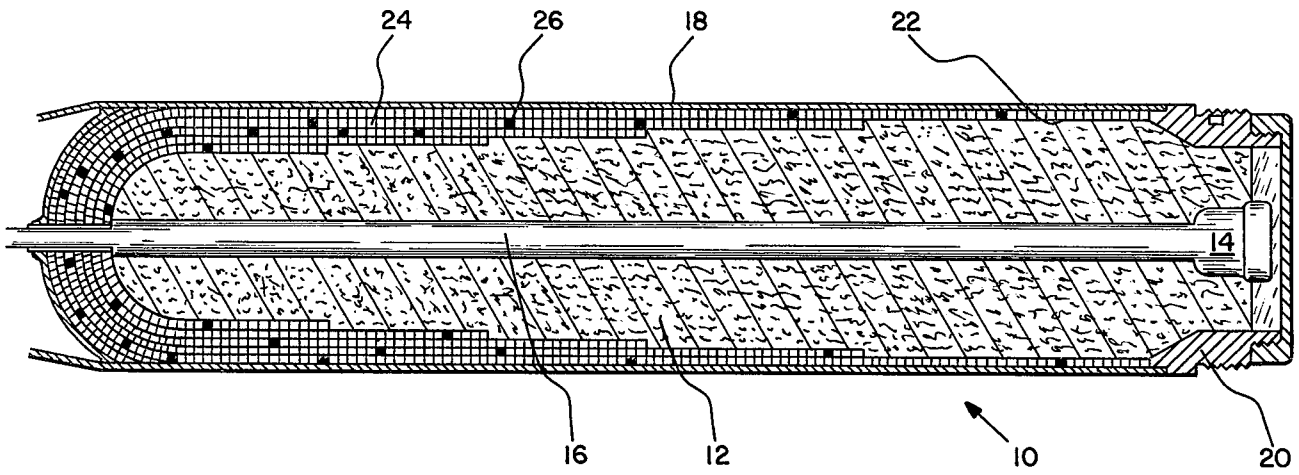
FIG. 1 is a longitudinal cross-sectional view of a warhead according to the present invention.

A warhead according to the invention is generally designated by numeral 10 in FIG. 1 and is shown as a missile warhead section. The warhead section 10 is designed for use in an air-to-surface all-weather weapon designed to seek out and destroy selected enemy installations. The weapon requires a warhead that will be effective against such targets, withstand all designated operational environments, be safe to handle, store and transport, and provide properly designed interfaces to allow assembly to adjacent components.

As shown in FIG. 1, the warhead section 10 comprises a high explosive charge 12 with a conventional arming and booster device 14 adapted to be fired from a forward guidance and control system (not shown) through a conduit 16 connecting the device 14 with the guidance and control section. The explosive charge 12 is contained within an outer casing 18 which may also serve as the skin of a missile carrying the warhead and a threaded flange 20 is fixed to the aft end of casing 18 to allow assembly to adjacent components of the missile.

Explosive charge 12 is cast or otherwise formed in a stepped configuration as shown, leaving a space 22 between the explosive charge 12 and casing 18. This space is shown filled with one or more rows of preformed 0.145-inch fragmentation cubes 24. These cubes are preferably cut from rectangular extruded bar stock and may be individually coated with plastic. In the ordinary warhead of this type the cubes are all formed of a mild steel, for example, and arranged in layers having a pattern and purpose as disclosed in Assignee's prior patent referred to above.

According to the present invention, a number of the fragmentation cubes 24 are replaced by pyrophoric cubes 26 of the same size. These pyrophoric cubes may be of zirconium or an alloy thereof, for example 90–10 zirconium-tin. As a practical matter, the zirconium used in the tests described below was a commercially available ASTMB 494, grade 703 or TWCA Incedaloy 501 which is 97% (minimum) zirconium and 0.5% (minimum) tin. The metal in these forms is susceptable to square wire extrusion and cold heading into cubes.

The zirconium cubes are preferably mingled with the steel cubes in ratios ranging from 2% to 12% before loading into the warhead cavity. After moderate mechanical blending the mixture is introduced into an agitator-loader. The agitator-loader dispenses the cubes into the cavity while causing a vibratory motion of the warhead casing. The zirconium cubes are, therefore, mingled with the steel cubes in a randomly dispersed fashion throughout the cavity. After the cubes are loaded a plastic material may be poured in to fill the interstices and stabilize the fragmentation section. A suitable plastic is Mil I 16923-type D insulating compound.

Figure 2:
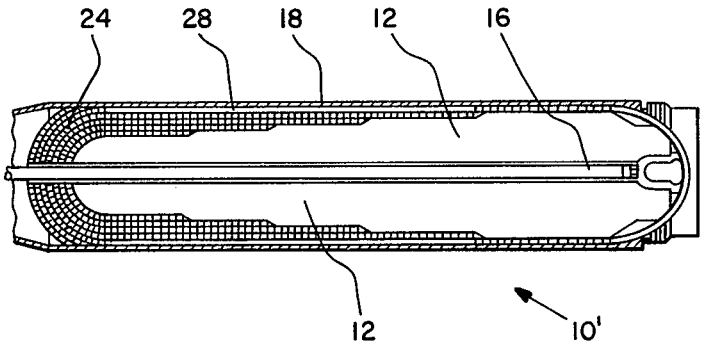
FIG. 2 is a view similar to FIG. 1 of a second embodiment of the invention.

A second modification of the invention is indicated generally in FIG. 2 by the numeral 10'. In this version, a plurality of discrete rods of pyrophoric material have been substituted for a peripheral portion of the fragmentation cubes 24 to form a peripheral sleeve 28.

Figure 3:
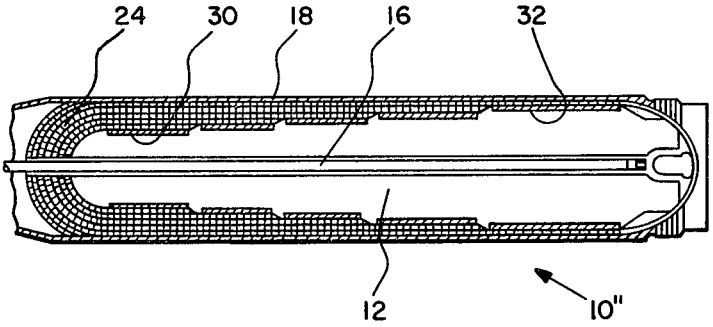
FIG. 3 is a view similar to FIG. 1 showing a third embodiment of the invention.

A third embodiment of the invention is indicated generally at 10'' in FIG. 3. In this modification, none of the cubes 24 are supplanted but the high-explosive 12 is shaped to allow the inclusion of a plurality of sleeves of pyrophoric material to be inserted between the warhead explosive 12 and the fragments 24. These sleeves are represented at numerals 30 and 32 with varying sizes depending upon the position within the warhead combination.

The addition of discrete elements of pyrophoric metal to the warhead not only increases the damage possibility by starting fires, but also provides a night marker useful in determining the effectiveness of the warhead by an observer even when no flammable material is present and no fires are started.

The combination of preformed steel fragments and discrete segments of pyrophoric metal has proved to be very effective in fire starting capability as well as night marking. In incendiary tests, drums of gasoline and other fuels were arranged around a warhead at distances ranging from 30 to 70 feet from the warhead at 60 to 120 degrees from the longitudinal plane of the warhead. The fire starting ability of the warhead was aptly demonstrated by these tests as fuel fires were obtained beyond the ability of the standard warhead.

We claim:

1. A fragmentation-incendiary warhead comprising, in combination;

an explosive section having an axis of symmetry;

a plurality of rows of generally cubical ferrous metal fragments arranged in a patterned array around said explosive section; and separate distinctly shaped pieces of solid zirconium of very nearly the same size and mass as said cubical steel fragments;

said pieces being intermixed with said cubical fragments for dispersal therewith when said explosive section is detonated.

2. The warhead of claim 1 wherein said pieces of pyrophoric metal comprise from 2 to 12 percent of the total number of fragments.

* * * * *